United States Patent [19]

Guzman

[11] Patent Number: 4,632,387

[45] Date of Patent: Dec. 30, 1986

[54] EXERCISE ENHANCING DEVICE

[76] Inventor: Horacio J. Guzman, 15702 Craighurst, Houston, Tex. 77059

[21] Appl. No.: 616,497

[22] Filed: Jun. 4, 1984

[51] Int. Cl.[4] ..... A63B 21/00

[52] U.S. Cl. ..... 272/116; 272/71; 441/58

[58] Field of Search ..... 272/1 B, 93, 71, 116, 272/67 R, 67 B; 441/56, 58; D21/236, 237, 238, 239

[56] References Cited

U.S. PATENT DOCUMENTS

| | | | |
|---|---|---|---|
| 242,773 | 6/1881 | Hayes | 441/58 |
| 262,466 | 12/1981 | Lewis | D21/239 |
| 373,692 | 11/1887 | Shaaber | 272/71 X |
| 1,140,107 | 5/1915 | Brown . | |
| 1,231,646 | 7/1917 | Pyros . | |
| 2,017,463 | 10/1935 | Komadina | 9/21 |
| 2,078,068 | 12/1934 | Eustis | 9/21 |
| 2,290,943 | 7/1942 | Conley | 9/21 |
| 2,529,313 | 9/1970 | Girden | 9/303 |
| 2,810,138 | 10/1957 | Cochran | 9/21 |
| 3,328,812 | 7/1967 | Berthiot | 9/307 |
| 3,417,415 | 9/1967 | Kozak | 9/309 |
| 3,428,980 | 2/1969 | Newton | 272/1 B X |
| 3,587,123 | 7/1971 | O'Boyle | 9/400 |
| 3,698,026 | 10/1972 | Buntin | 9/308 |
| 3,724,012 | 4/1973 | Sanderson | 9/311 |
| 3,786,526 | 1/1974 | Ausseil | 9/307 |
| 3,789,447 | 2/1975 | Lavallee | 9/303 |
| 3,913,907 | 10/1975 | Baker | 272/93 |
| 4,233,925 | 11/1980 | Proctor | 441/56 X |
| 4,300,759 | 11/1981 | Caplan | 272/71 X |
| 4,458,896 | 7/1984 | Solloway | 272/116 |
| 4,480,829 | 11/1984 | Yacoboski | 272/116 |
| 4,493,663 | 1/1985 | Richmond | 441/56 X |
| 4,509,744 | 4/1985 | Beasley | 272/71 X |
| 4,521,011 | 6/1985 | Solloway | 272/71 X |

*Primary Examiner*—Richard J. Apley
*Assistant Examiner*—Robert W. Bahr
*Attorney, Agent, or Firm*—Dodge, Bush & Moseley

[57] ABSTRACT

Exercise enhancing devices attached to the foot and leg of a person to enable selective development of the muscles in aquatic environment. The devices are provided with adjustable vent apertures that enable adjustment of the water resistance to movement of the device to achieve compatability with the desires of the user. A body support device releasably attachable to the side of a swimming pool enables the devices to enhance torso or abdominal exercises in order that a complete workout of all or selected body muscles may be achieved.

5 Claims, 8 Drawing Figures

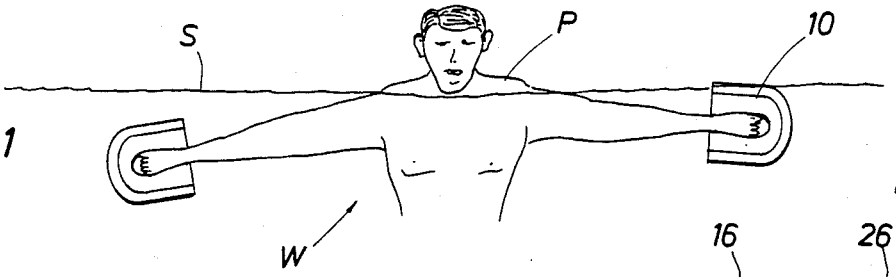
FIG. 1
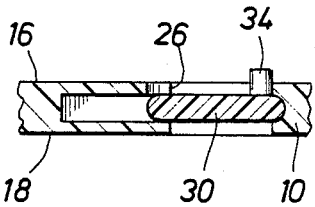
FIG. 5
FIG. 2
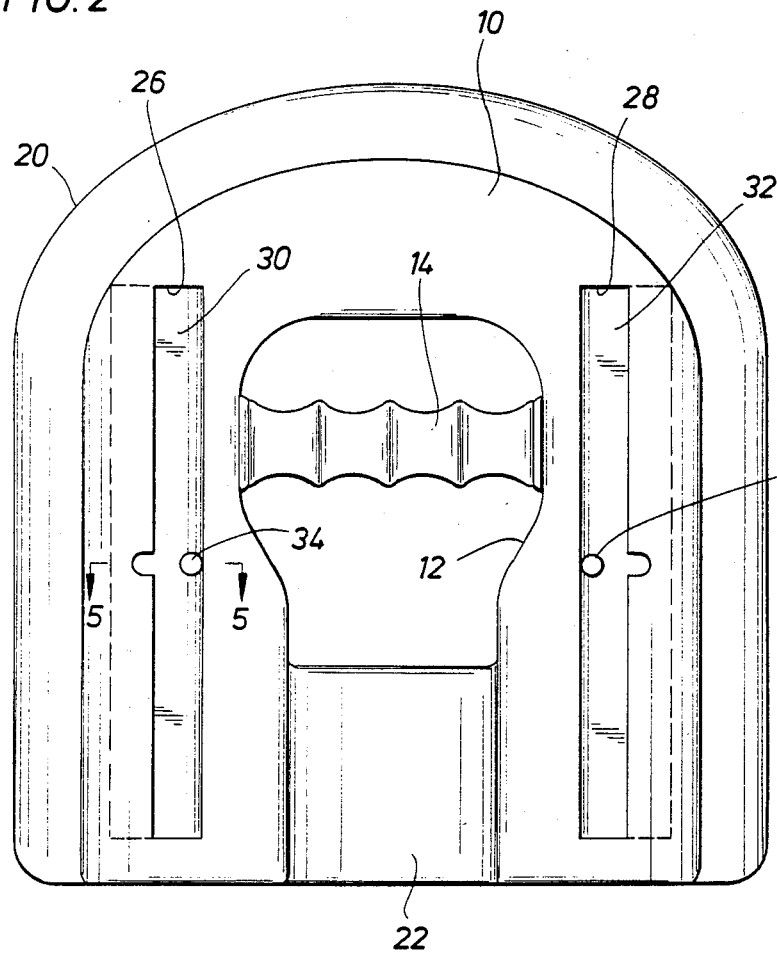
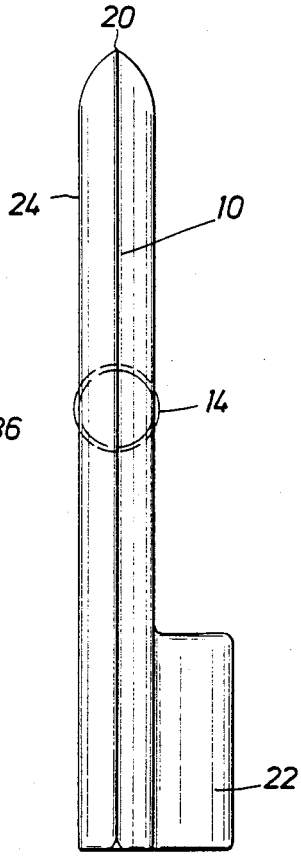
FIG. 3
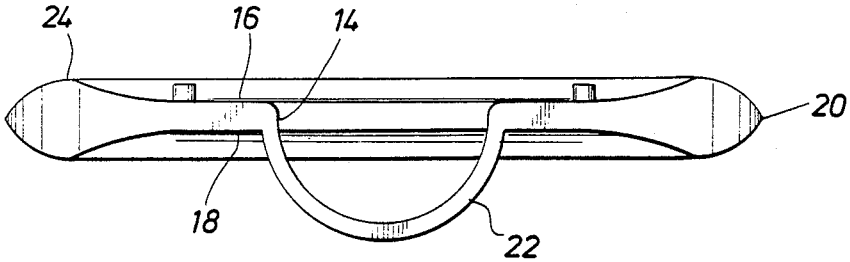
FIG. 4

FIG. 6
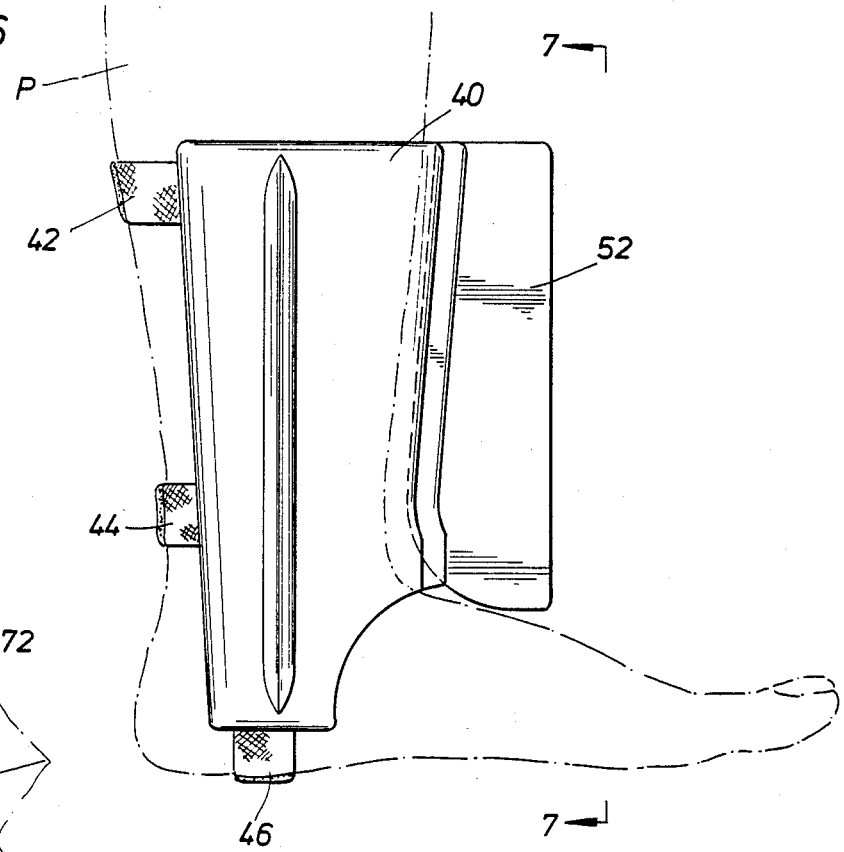
FIG. 8
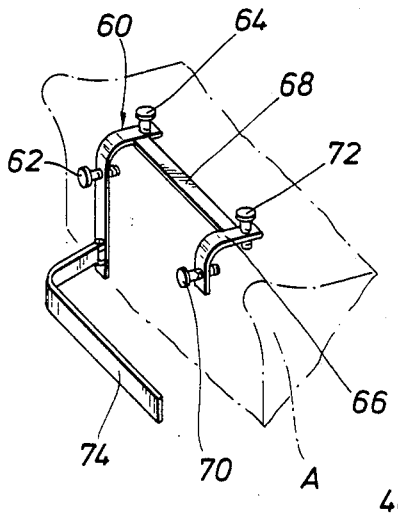
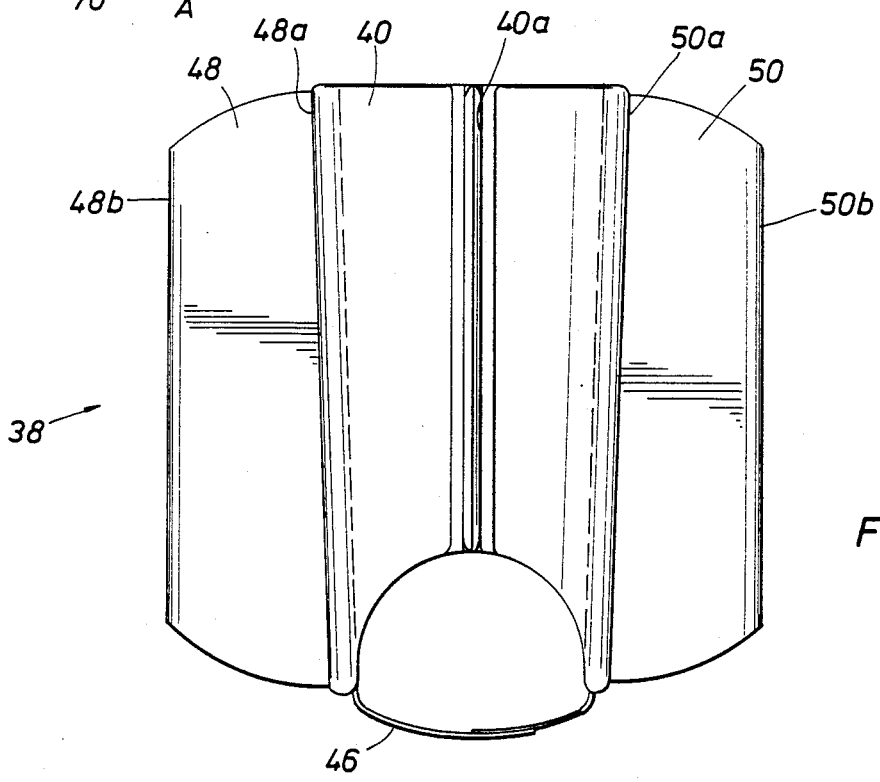
FIG. 7

EXERCISE ENHANCING DEVICE

BACKGROUND OF THE INVENTION

1. Field of the Invention

This invention relates to the field of exercise enhancing devices are particularly to a device for increasing the water resistance to body limb movement to enhance muscle exercise activities.

2. Background Art

Many individuals simply prefer to workout or physically exercise in a swimming pool or other aquatic environment. Other persons are limited, for various reasons, to this type of physical workout.

Aquatic exercise enhancing devices are known. The disclosed apparatus of U.S. Pat. No. 4,300,759 include both arms and leg attached devices which can be exercised alone or in any desired combination. The devices were pneumatically inflated for use which rendered them extremely buoyant when submerged and somewhat difficult to control. The inexpensive lightweight inflatable construction was not particularly durable and because of the buoyancy factor, they were unsuitable for certain exercises as they would assist rather than resist the exercise movement of certain muscles. While the inflation pressure could control to some degree the water resistance to movement of the device, such enhanced resistance was essentially uniform for movement in any direction which limited the ability to focus on development or exercise of a specific muscle or group of muscles. Such exercise enhancing device serve an entirely different purpose and function from swimming aids such as foot attached flippers for increasing the effectiveness of leg kicks during swimming.

Other swimming aid devices for increasing the effectiveness of the user's swimming effort are also known. For example, U.S. Pat. No. 3,786,526 to Aussell discloses an attachment for placing on either the forearm or the leg and is formed of a pair of fins disposed at angles to each other. One of the fins serves as a rudder while the other fin acts to oppose movement of the limb. This provides greater stability and increases the effectiveness of the propelling stroke of the users while swimming.

U.S. Pat. No. 1,140,107 discloses a swimming aid device which also fits over the forearm and is gripped by the user's hand. Other prior art also discloses swimming aid arrangements which are attached to the hands or lower leg of the person swimming. Examples of such arrangement are found in U.S. Pat Nos. 1,231,646 to Pyros; 2,017,463 to Komadina; and 2,078,068 to Eustis.

U.S. Pat. No. 3,789,447 to Lavallee discloses a swimming accessory having an aperture therethrough which is hinged to the base in order that the aperture is closed during a positive stroke and then which swings open to reduce the negative water action on the retraction stroke. Such device is designed for attachment to the forearm as is the swim paddle of U.S. Pat. No. Des. 262,477 to Lewis.

A number of swimming aids are disclosed for use on the hand of the swimmer. Such devices may be attached by the use of straps of various types but all are in employed to increase the effective area of water against which the swimmer pushes while the swimmer propels himself through the water. Examples of such hand attached swimming elements are disclosed in U.S. Pat. Nos. 3,698,026 to Buntin; 3,529,313 to Girden; and 3,417,415 to Kozak. Other examples of such swimming aid devices are disclosed in Conley U.S. Pat. No. 2,290,943; Cochran U.S. Pat. No. 2,810,138; and Berthiot U.S. Pat. No. 3,328,812.

Devices for attachment to the side of a pool to support an individual in the pool are known. In Sanderson U.S. Pat. No. 3,724,012, a support device for the head of person swimming is disclosed. U.S. Pat. No. 3,587,123 discloses a detachable boat boarding apparatus to assist a swimmer from the water.

It is an object of the present invention to provide an improved aquatic exerciser device.

It is another object to provide an aquatic exercise device that may be selectively employed to develop certain muscles or groups of muscles.

SUMMARY OF THE INVENTION

The present invention relates to the field of exercise enhancing apparatus for use in an aquatic environment.

Both hand and ankle mounted devices are provided in order that most all body muscles may be selectively exercised. The hand grasped device is formed by a paddle member having an opening with a gripping handle positioned therein. An arm brace bridges a portion of the opening for engaging the users arm to maintain the paddle in the desired position. The paddle is provided with a thicker portion adjacent its periphery to provide a scoop for increasing water resistance while the periphery is tapered toward the thicker portion to minimize water resistance to movement parallel to the parallel flat surface of the paddle. One or more vent apertures are formed through the paddle. Movable closure members are adjustably disposed in the vent apertures to control the flow of fluid thorugh the apertures and the resulting water resistance of the paddle to suit individual capabilities or desires.

The ankle mounted device includes a flexible leg jacket releasably securable about the user's ankle. The jacket mounts a pair of fins extending radially outwardly in substantially the same plane to provide increased water resistance. Preferably, the jacket also forms a slot for receiving a third fin disposed in a plane substantially perpendicular to the first two mentioned fins for enhancing side kick exercises.

For exercising torso or abdominal muscles, a body supporting frame is provided for releasably securing to the edge of the pool or aquatic environment. The ankle mounted devices are then employed in a predetermined sequence to enhance torso muscle exercises.

By controlled use of the exercise enhancing devices, exercise and development of selected muscles can be quickly accomplished. A full exercise routine will tone and exercise all body muscles in a rapid fashion.

Preferably the devices are formed slightly buoyant of non-corrosive, durable materials to provide a long useful life.

BRIEF DESCRIPTION OF THE DRAWINGS

FIG. 1 is a partial front view of an individual utilizing the hand gripped exercise enhancing devices of the present invention;

FIG. 2 is a top view of the hand gripped exercise enhancing device utilized in FIG. 1;

FIG. 3 is a side view of the hand gripped exercise enhancing device of FIG. 2;

FIG. 4 is an end view of the hand gripped exercise enhancing device of FIG. 2;

FIG. 5 is a view taken along lines 5—5 of FIG. 2;

FIG. 6 is a side view of the ankle attached exercise enhancing device of the present invention;

FIG. 7 is a view taken along lines 7—7 of FIG. 6; and

FIG. 8 is a perspective view of the body supporting frame for use in torso or abdominal exercises.

DESCRIPTION OF THE PREFERRED EMBODIMENT

The exercise enhancing apparatus of the present invention, generally designated A. The apparatus A includes a hand gripped exercise enhancing apparatus 10 best illustrated in FIGS. 2–5 and a foot attached enhancing apparatus 38, FIGS. 6–7, with the latter apparatus used in conjunction with a body supporting device 60 (FIG. 8) to enhance exercising of the torso or abdominal exercises.

The hand grip apparatus or paddle member 10 is provided with a central opening 12 for receiving the hand of the user when utilizing the exercising enhancing apparatus 10 in a body of water W with a surface S ( FIG. 1). A gripping portion or handle member 14 is disposed in the opening for grasping by a person P desiring to exercise using the paddle member 10.

The paddle member 10 is provided with a pair of substantially parallel flat outer surfaces 16 and 18 within an outer periphery 20. The central opening 12 extends to the periphery 20 to provide clearance for the arm of the hand gripping member. An arm brace 22 bridges the opening 14 for engaging the arm of the hand of the person P grasping the gripping member 14 to rigidly fix or attach the paddle member 10 in a desired exercise enhancing position relative to the user. The paddle member 10 is preferably formed to have a slight buoyancy in order that it will float to the surface S of the water W or aquatic environment E when in use. However, the buoyancy is so controlled to minimize any detrimental effect on the exercise enhancement.

As best illustrated in FIG. 4, the paddle member 10 is provided with a thicker portion 24 disposed adjacent the periphery 20 to form a scoop for increasing the water resistance to movement of the paddle member 10 through the water substantially perpendicular to the surfaces 16 and 18. The paddle member 10 tapers between the thicker portion 24 and the periphery 20 to minimize the water resistance of the paddle member 10 when moved parallel to the surfaces 16 and 18. This enables selective development of muscles by manipulating the paddle member 10 when desired by the user.

Disposed on either side of the opening 12 are a pair of elongated vent apertures or bypass slots 26 and 28. The elongated slots 26 and 28 each have a movable closure member 30 and 32 disposed therein for regulating or controlling the passage of water through the vent apertures 26 and 28 when moved in a direction perpendicular to the substantially parallel surfaces 16 and 18. When in the position illustrated in FIG. 5, the movable closure or valve member 30 blocks flow of all water through the elongated aperture 26 for providing maximum resistance to the paddle 10 movement in the water W. The closure member 30 may be provided with an operating knob or stem 34 for the users convenience in moving the movable closure member 30 from the fully closed position to the fully opened position by sliding the closure member 30 within the slot or recess of the elongated opening 26. The frictional engagement between the member 10 and the closure member 30 enables closure member 30 positioning at selected intermediate positions between the full open position and the closed position to adjust water resistance to the users capability. The closure member 32 is operated by the handle 36 in a similar manner to control the quantity of water passing through the elongated passage 28.

As mentioned previously, the leg mounted exercise enhancing device 38 is illustrated in FIGS. 6 and 7. A flexible leg jacket 40 is adapted to be secured about the ankle of a person P desiring to perform exercises using the enhancing device of the present invention. The leg jacket 40 is releasably secured to the foot and leg of the person desiring to perform leg exercises by suitable means such as the velcro-type closure fastening straps illustrated. One or more pairs of straps 42, 44 may be employed to attach the leg jacket 40 to the leg while strap 46 may be employed to secure the leg jacket 40 about the user's foot.

A pair of fins 48 and 50 are mounted on the leg jacket 40 for providing the increased water resistance. Each of the fins 48 and 50 have a first edge **48*a* and 50*a* connected or mounted permanently to the leg jacket 40 or the fins 48 and 50 may smugly fit in elongated slots formed in the leg jacket if desired. Each of the fins 48 and 50 has a second edge 48*b* and 50*b*, respectively, disposed radially outwardly from the leg jacket 40 with the pair of fins 48 and 50 disposed in substantially a common plane when the leg jacket is releasably secured to the person P desiring to exercise. The fins 48 and 50 are disposed on the sides of the foot for resisting forward and backward movement or kicks of the foot through the water. To enhance leg sidekick exercises, the leg jacket is provided with a slot 40*a* for removably receiving a third fin 52 therein. The third fin 52 (FIG. 6) provides enhanced water resistance to user side kick movement of the leg jacket 40 in a direction parallel to the plane of the first and second fins 48 and 50. If desired, the fins 48, 50 and 52 may be provided with elongated vent apertures (not illustrated) in the manner similar to the vent apertures of the hand grasp device 10**.

In order to exercise torso or abdominal muscles with the leg mounted devices 38, a body supporting frame or device 60 (FIG. 8) is employed. The frame 60 includes a curved body support member 62 which is releasably clamped to the pool edge A by a pair of securing bolts 62 and 64. A second curved mounting member 66 rigidly connected by a spacing cross brace 68 to support member 60 is clasped to the pool edge A be securing bolts 70 and 72. A strap (not illustrated) or a curved horizontal support bar 74 connected to the body support member 60 provides the user body contacting support. By the user positioning his chest between the pool edge A and the support bar 74 leg lift and kick movements using the foot mounted devices 38 will exercise and strengthen the abdominal and torso muscles.

In commercializing the present invention it is contemplated that two of the hand paddles 10 and two of the leg devices 38 will be packaged with the support frame 60. Pairs of the hand paddles 10 and leg devices 38 may be packaged separately.

USE AND OPERATION OF THE PRESENT INVENTION

In the use and operation of the present invention, the individual desiring the physical workout will select the appropriate device for the muscle to be developed. He will then grasp the hand paddle 10 with each hand or attach the leg device 38 to each ankle as desired before or after entering the body of water W in which the exercises are to be performed. The devices are rendered slightly buoyant and may be left floating on the surface of the water or the side of the pool or other body of water until desired for use.

If it is desired to exercise the biceps, the individual will take the hand grip devices and stand in the body of water preferably with the water surface S at about neck level. By holding the upper arm substantially vertical against the users side and swinging the paddle devices 10 upwardly through an arc pivoting around the elbow, the bicep muscles will be developed or exercised. The paddle member 10 is maintained in a plane substantially perpendicular to the movement to enhance the biceps. Such movement is repeated as desired. If it is desired to exercise the triceps, the hand paddle device is moved downward back to the start position. If the development is to be solely on the biceps, the device is turned vertical on the backstroke in order to minimize the water resistance to the device on the backstroke. Such manipulation of the paddle will serve to selectively develop specific muscles or groups of muscles.

The forearm and wrist muscles can be developed at the same time by holding the arms in a parallel horizontal forward extending position and imparting a rotary motion to each of the devices from one side to the other. This will develop the forearm and wrist.

To develop the shoulder muscles, the hand grasp paddles are moved between the upper horizontal side extended position of the arms and the lower vertical position by the sides of the individual. Preferably, the hand held devices are held horizontally on the upstroke and downstroke, but may be turned vertical for returning down to the side of the body. If desired, the arms can be carried to an overhead position out of the water to increase the range of muscle stretching.

A chest exercise may also be performed by turning the hand paddle exercise devices 10 to the vertical position and then extending the arms in a horizontal parallel position forward of the individual. The extended arms are then swung through arcs back to the horizontal side extended outstretched position. The arms may then be returned from the extended side position back to the front of the body a sufficient number of times to exercise the chest. If desired, the devices may be turned horizontal to minimize water resistance when returning to the original side outstretched position. If the paddle devices 10 are maintained in the vertical movement resistant position as the devices are swung from the forward extended position to the side oustretched position, the back muscles are exercised.

A variation of the shoulder exercise would be to hold both paddle devices 10 fully extended in front of the body with the devices in the horizontal position. Moving the arms stiff in a vertical downstroke will exercise the shoulder muscles. By turning the device vertical on the downstroke and horizontal on the upstroke to increase the resistance only the shoulder muscles will be exercised. By maintaining the device in the horizontal position on the downstroke, the chest muscles would also be exercise.

Many of the exercises for the leg muscles are preferably done with the body support 60 mounted on the side of the pool, but many exercises may be done with only the leg devices 38. The most common exercise using the leg attached devices is to hold the side of the pool with the hands and while maintaining the knees in the extended unbending and locked position to kick the legs rapidly in both directions. This can also be done by the person turning around and holding to the gutter or pool edge and while facing upwardly do the same leg kick exercise.

A variation of this exercise is to hold the side of the pool while facing the edge and kick bending the knees while maintaining the leg attached exercising devices 38 below the water level S. The position of the individual can be reversed and while facing away from the side of the pool, but while still holding on, kicking while bending the knees.

A third exercise enhancing device is to use the holding device 60 on the pool edge and lifting the legs having leg devices 40 secured thereon to assume a sitting position without bending the knees. The legs are then swung downwardly from the knee for moving the lower leg or calf from the vertical to horizontal plane. This exercise is repeated as desired. It may also be done with one leg and then with the other.

A variation of this exercise is done using side kicks while holding on to the side of the pool and being held by the securing device. In this exercise the removable front leg fin 52 is placed in the slots 40*a* on the leg attachment and the leg is moved sideways to as near a horizontal position as possible. This exercises the thigh region muscles and firms the inner thighs as well.

To firm the abdominal muscles, the pool holding device is also utilized and the abdominal muscles are used to swing the fully extended legs with the knees locked from the vertical position simultaneously to the horizontal position and back. Because the knees are locked straight during the exercise a body support is necessary as the user's whole body will bob up or down. A variation of this exercise is to hold on to the pool edge and bring the bended knees up to chest and then stretch out with the legs extended substantially horizontally.

The foregoing disclosure and description of the invention are illustrative and explanatory thereof, and various changes in the size, shape and materials, as well as in the details of the illustrated construction may be made without departing from the spirit of the invention.

What is claimed is:

1. An exercise enhancing device for use in an individual's physical workout in an aquatic environment, including:

a substantially rectangular paddle member having an outer periphery spaced from and surrounding a central opening with a hand gripping member disposed in said opening and mounted substantially in the center of said rectangular paddle member for grasping by a person desiring to exercise using said paddle member, said paddle member having a pair of substantially parallel outer surfaces within said periphery for providing the exercise enhancing water pressure resistance to movement of said paddle member in either direction perpendicular to the plane of said substantially parallel surfaces, movement of said paddle member parallel to said outer surfaces providing a minimum of water pressure resistance to enable selective muscle exercise enhancement;

said central opening extending to a portion of said periphery to provide clearance for the arm of the user hand grasping said gripping member while;

an arm brace secured to said paddle member bridging said opening for engaging the arm of the and grasping said gripping member to rigidly fix said paddle member relative to the gripping hand of the user in an exercise enhancing position; and said paddle member having a thicker portion adjacent said periphery and extending continuously about said periphery from adjacent one of said parallel outer surfaces to adjacent the other of said parallel outer surfaces to form a substantially U-shaped thicker portion of said paddle outwardly of and substantially surrounding said central opening for forming scoops on said outer surfaces for increasing the water resistance to movement of said paddle member through said water.

2. The exercise enhancing device of claim 1, wherein:

said paddle member having at least one vent aperture formed therethrough;

each said vent aperture having a movable closure member disposed therein for regulating the passage of water through said vent aperture to control the water resistance of said paddle member when moved in a direction perpendicular to the substantially parallel surface.

3. The exercise enhancing device of claim 2, wherein:

said vent apertures are a pair of elongated slots formed in said paddle member on either side opening and spaced therefrom.

4. The exercise enhancing device of claim 1, wherein:

said paddle member having a tapered shape between said thicker portion and said periphery to minimize the water resistance of said paddle member.

5. The exercise enhancing device of claim 1, wherein:

said paddle member having a slight buoyancy for floating while minimizing the buoyancy effect on the user during exercises.

* * * * *